United States Patent [19]

Stauffer et al.

[11] 4,148,130

[45] Apr. 10, 1979

[54] CABLE HARNESS ASSEMBLY APPARATUS

[75] Inventors: Larry R. Stauffer, Camp Hill; William J. Stape, Lewisberry; Charles W. Donnelly, Sr., Camp Hill, all of Pa.

[73] Assignee: AMP Incorporated, Harrisburg, Pa.

[21] Appl. No.: 858,033

[22] Filed: Dec. 6, 1977

[51] Int. Cl.[2] ..... H01R 43/04

[52] U.S. Cl. ..... 29/566.3; 29/747; 29/749; 29/753

[58] Field of Search ..... 29/747, 749, 751, 753, 29/566.3, 566.4, 628, 629

[56] References Cited

U.S. PATENT DOCUMENTS

| | | | |
|---|---|---|---|
| 4,020,540 | 5/1977 | Casciotti et al. | 29/749 |
| 4,043,017 | 8/1977 | Folk et al. | 29/749 |
| 4,077,695 | 3/1978 | Bakermans | 29/749 X |

*Primary Examiner*—Carl E. Hall

*Attorney, Agent, or Firm*—Russell J. Egan

[57] ABSTRACT

A harness assembly apparatus is disclosed for sequentially applying, at the appropriate locations, multi-contact connectors to multi-conductor cable and, in a reverse operation, applying covers to the thus terminated connectors. The apparatus includes means for assuring proper alignment of the cable at the time of application to the connector as well as fixtures to be used at the ends of the harness to cut the cable adjacent the end most connectors. The subject apparatus can be manually or automatically indexed to the proper positions as noted by placing of a connector fixture at the proper locations on a frame assembly.

5 Claims, 9 Drawing Figures

CABLE HARNESS ASSEMBLY APPARATUS

BACKGROUND OF THE INVENTION

1. The Field of the Invention

The present invention relates to an apparatus for assembling cable harnesses and in particular to an apparatus which sequentially applies multi-terminal carrying connectors to the proper locations of multi-conductor cable.

2. The Prior Art

It is often necessary to provide a multi-conductor cable harness with a plurality of connectors spaced therealong at appropriate intervals. The thus formed harness can then be used to interconnect a plurality of like units, such as printed circuit boards, all of which are similarly powered and actuated.

While it is possible to form harnesses from individual conductors, the most convenient way of making a multi-conductor harness is to utilize flat cable formed by a plurality of parallel conductors embedded in a layer of insulation. However, there are problems with alignment of such cable to accurately terminate the conductors. These problems are, in part, caused by drift of the conductors within tolerances, within the cable and uneven flash at the edge of the cable. There are also problems associated with known machinery for assembling harnesses in both indexing the cable for correct termination and cutting the cable at the ends of the harness.

SUMMARY OF THE INVENTION

The present invention is an apparatus for forming cable harness assemblies and includes a press member having a ram carrying on one end thereof a tool compatible with the connectors to be utilized, means to actuate the ram, means to feed a multi-conductor flat cable to a location beneath the ram, the cable feeding means including alignment means, and an elongated frame member with a plurality of connector carrying fixtures detachably secured thereon extending transversely thereto. The first and last connector carrying fixtures on the frame member include a cutting blade on the remote ends thereof so that the cable will be automatically cut adjacent the connector with the termination actuation of the tool. The assembly further includes means to index the frame member to position the respective connector carrying fixtures beneath the ram to sequentially apply the connectors to the cable.

It is therefore an object of the present invention to produce an improved cable harness assembly apparatus which will more accurately align multi-conductor cable with the connectors to be applied thereto.

It is a further object of the present invention to produce a cable harness assembly apparatus which can be readily changed to accommodate cable harnesses of varying configurations.

It is yet another object of the present invention to produce a cable harness assembly apparatus in which the connectors are carried in parallel spaced alignment on a frame which is sequentially indexed beneath a ram carrying tool to sequentially apply the connectors to the cable.

It is yet another object of the present invention to produce a cable harness assembly apparatus which can be readily and economically produced.

The means for accomplishing the foregoing objects and other advantages of the present invention will be apparent to those skilled in the art from the following detailed description taken with reference to the accompanying drawings.

DETAILED DESCRIPTION OF THE PREFERRED EMBODIMENT

Figure 1:
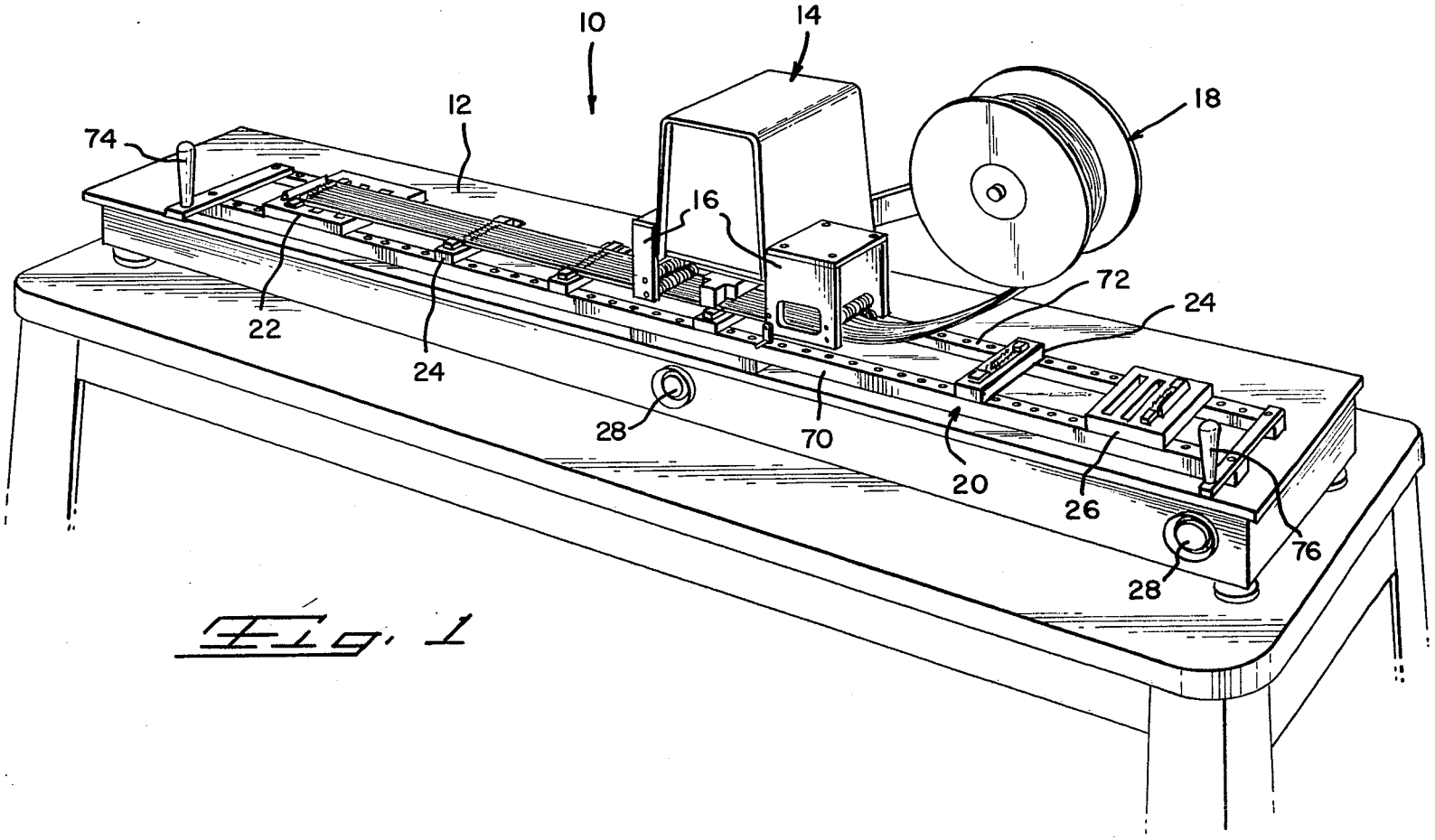
FIG. 1 is a perspective view of the subject cable harness assembly apparatus.

The subject cable harness assembly apparatus 10 includes a base 12 having a known press assembly 14 mounted thereon. Immediately adjacent to the press assembly 14 is a cable feed and alignment means 16 and a cable supply 18. An elongated index frame 20 is mounted for lateral movement along the base 12 beneath the press assembly 14 and includes a first cutter and connector carrying fixture 22 at one end thereof, a plurality of connector carrying fixtures 24 spaced therealong, and a second cutter and connector carrying fixture 26 at the opposite end.

The press assembly 14 need not be discussed in detail since it is of a well known type, for example, the press disclosed in U.S. Pat. No. 4,020,540, the disclosure of which is incorporated herein by reference. The ram assembly may be actuated by electrical or pneumatic means (not shown) by operating switches 28. The press assembly basically includes a frame 30 with a vertically actuated ram 32 carrying a crimp tool 34 on the free end thereof. The tool 34 includes alignment pins 36 depending therefrom.

Figure 9:
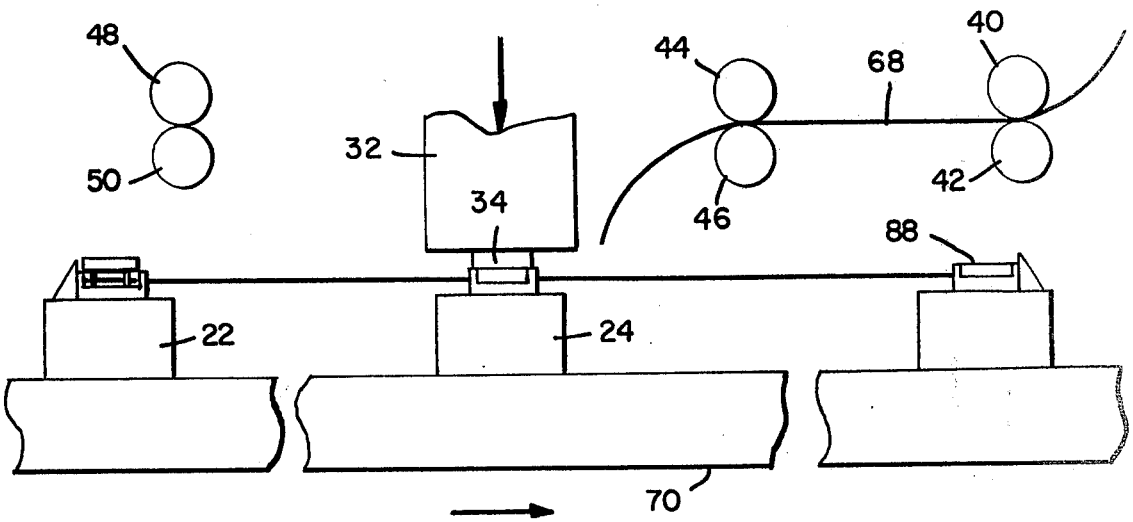
FIG. 9 is a schematic view, similar to FIGS. 4 to 8, of the return trip of the frame with the ram carried tool applying covers to the terminated connectors.
Figure 3:
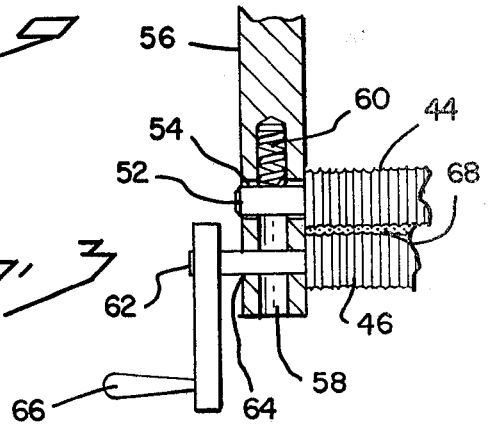
FIG. 3 is a detailed vertical section showing the means for mounting the cable alignment rollers.

The cable feed and alignment means 16 includes first and second portions 36, 38 positioned on opposite sides of the ram 32. The first portion 36 includes first and second pairs of fluted rollers 40, 42, 44, 46 and the second portion 38 includes a similar pair of rollers 48, 50. The mounting of the pairs of rollers 40, 42, 44, 46, 48 and 50 is shown in FIG. 9 with the pair of rollers 44, 46 being representative of all of the pairs. Roller 44 is mounted on a shaft 52 which passes through elongated apertures 54 in the wall 56 of the cable feed assembly 16. A bore 58 intersects the aperture 54 and has a spring 60 mounted therein to act upon shaft 52. Roller 46 is mounted on shaft 62 which passes through apertures 64 and a crank 66 is fixed to the end of shaft 62. Thus roller 44 will be spring biased against roller 46. Both rollers are fluted and define therebetween a continuous series of conductor passages. The cable 68 feed between the pairs of rollers will be aligned according to the location of the conductors therein rather than upon any other physical feature of the cable.

The index frame 20 is a generally rectangular rigid member having a pair of parallel, spaced side members 70, 72 with handles 74, 76 on the opposite ends thereof. A first cutter and connector carrying fixture 22 is detachably secured to the frame members 70, 72 adjacent one end thereof with a cable cutter blade 78 nearest the handle 74. The side members 70, 72 of the frame 20 are provided with a plurality of indexing holes spaced therealong to secure therein the appropriate fixtures 22, 24, 26 at the desired locations. The fixtures 24 are spaced along the frame according to the dictates of the harness being manufactured and the second cutter and connector carrying fixture 28 is positioned where it will be aligned with the end of the cable harness. The frame also includes means, such as the rack and gear 80, 82 schematically shown in FIG. 4, for indexing the frame 20 to position the connector carrying fixtures beneath the ram.

Figure 2:
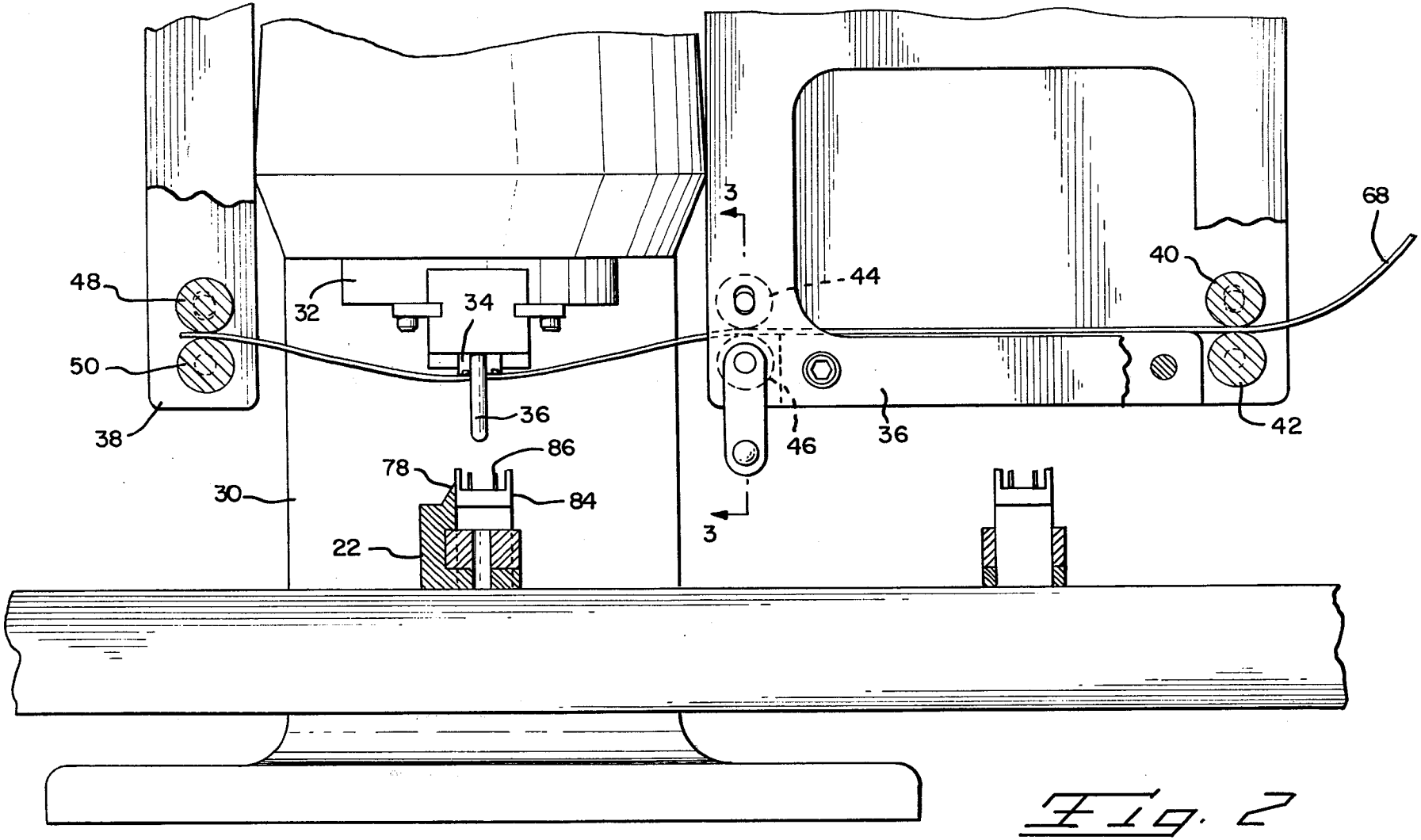
FIG. 2 is an enlarged front elevation, partially in section, of the cable feed and termination portion of the present invention.
Figure 8:
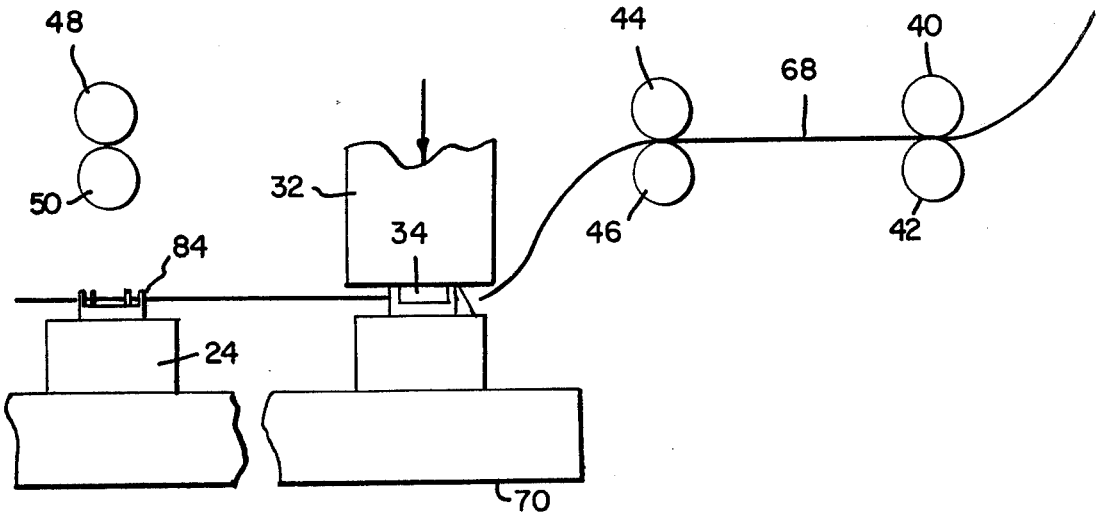
FIG. 8 is a schematic view, similar to FIGS. 4 to 7, of the termination and cutting of the cable with application of a final connector to the thus formed harness.

The subject apparatus is preferably used with connectors of the type disclosed in U.S. Pat. No. 3,820,055, the disclosure of which is incorporated herein by reference. These connectors 84 each include a rigid housing having a plurality of insulation displacing terminals 86 fixed therein and a mating cover 88. The connectors 84 are placed in the respective fixtures 22, 24, 26 in a terminal up position, as shown in FIG. 2.

Figure 4:
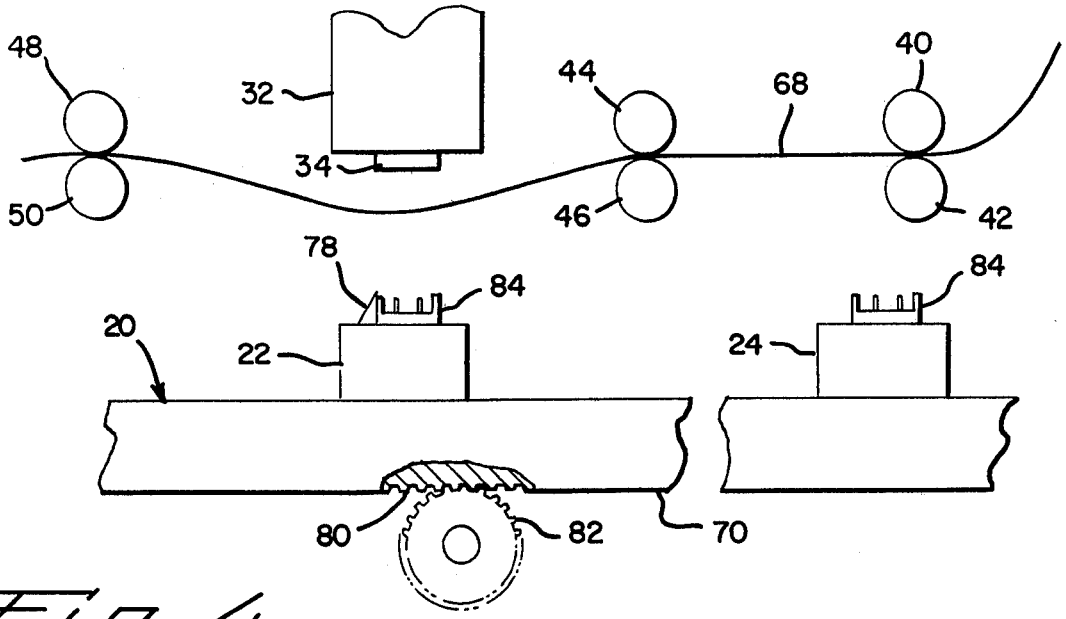
FIG. 4 is a schematic representation of the present invention showing the alignment of a cable with a first connector.
Figure 5:
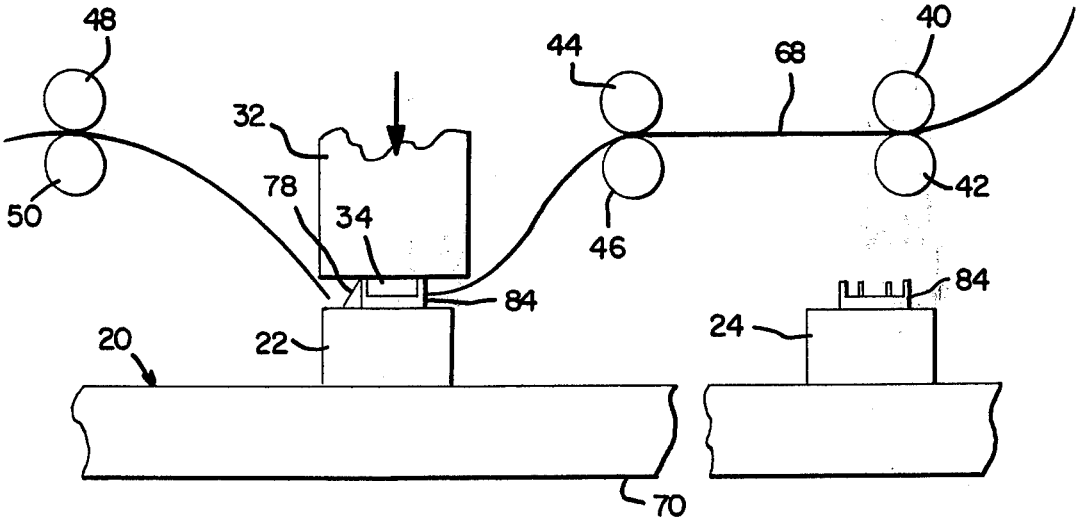
FIG. 5 is a schematic view, similar to FIG. 4, showing the step of cutting and terminating a first end of the cable.
Figure 6:
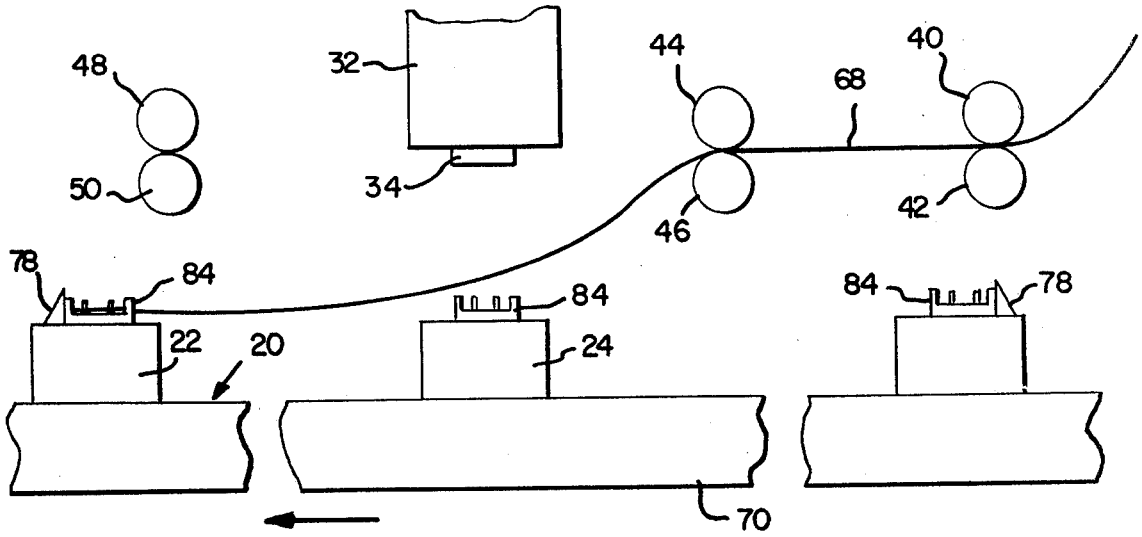
FIG. 6 is a schematic view, similar to FIGS. 4 and 5, of the step of indexing a connector carrying frame to the second or subsequent connector location.
Figure 7:
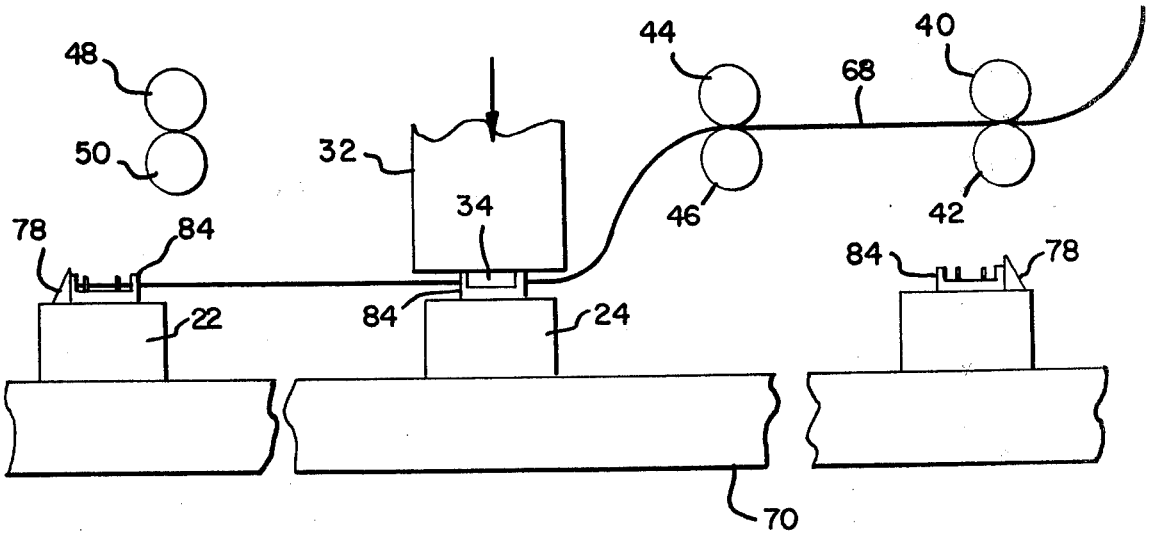
FIG. 7 is a schematic view, similar to FIGS. 4 to 6, of the termination of the connector of FIG. 5.

The operation of the present invention will be explained with reference to FIGS. 4 to 9 which show the sequential operational steps. The indexing frame 20 is first provided with fixtures 22, 24, 26 fixed thereto at the locations dictated by the specification of the harness to be manufactured. The frame 20 is then mounted on the assembly apparatus and positioned to be indexed through the press assembly 14. The fixtures are each loaded with a connector member. A spool of cable 18 is mounted on the apparatus with the cable 68 being fed through the pairs of rollers 40, 42, 44, 46, 48, 50 to extend beneath ram 32 and the tool 32. The fluting in the respective pairs of rollers serves to align the cable 68 with respect to the tool 34. The frame 20 is indexed to position the first fixture 22 beneath the ram 30 and tool 32, as shown in FIG. 4, and the ram is actuated, as shown in FIG. 5, to bring the tool 34 into engagement with the cable 68 and drive it against the cutting blade 78 to trim the end of the cable while driving the conductors into engagement with the respective terminals of the connector 84. The frame 20 is then indexed to the next sequential fixture 24, as shown in FIG. 6. The indexing of the frame 20 causes the cable 68 to be drawn through the rollers 40, 42, 44, 46 maintaining the alignment of the cable with respect to the tool 32. The next and all subsequent connectors are terminated onto the cable as shown in FIGS. 6 and 7 until the last fixture 26 is positioned beneath the ram and tool. The subsequent actuation of the ram causes the cable to be severed as well as the cable to be terminated to the last conductor. Covers 88 are placed on the terminated connectors 84 and the frame is then indexed in the reverse direction to apply the covers 88 to the terminated connectors 84. The completed harness is then removed from the frame which is then reloaded with connectors to be ready for forming the next harness.

It is within the purview of the present invention to include means to sequentially load connectors and covers into the fixtures by automatic means as well as to operate the entire apparatus by automatic cycling by computer or tape control (not shown).

It should also be noted that the end fixtures 22, 26 can be provided with additional connector receiving recesses, as shown in FIG. 1, if it is desired not to trim the cable immediately adjacent the last connector but to leave a tab which can be provided with other termination means.

The present invention may be subject to many modifications and changes without departing from the spirit or essential characteristics thereof. The present embodiment should therefore be considered in all respects as illustrative and not restrictive of the scope of the invention

I claim:

1. A cable harness assembly apparatus comprising:

a base;

a press fixedly mounted on the base and including a vertically actuated ram carrying a conductor insertion tool on a free end thereof;

an index frame including at least one elongated rail member;

a plurality of connector carrying fixtures detachably secured to said index frame in parallel spaced alignment extending transverse to said at least one rail member;

means to move said index frame beneath the press; and means to feed multi-conductor flat cable beneath said ram in the direction of movement of said index frame, said feed means including means to align the conductors of the cable with said insertion tool, whereby terminal carrying connectors loaded in said fixtures are sequentially terminated to said cable as said fixtures are indexed under the press in a first direction and covers subsequently placed on the terminated connectors are secured to said connectors during indexing in the opposite direction.

2. A cable harness assembly apparatus according to claim 1 wherein:

at least one of said connector carrying fixtures includes cable cutting means whereby the cable is severed with the terminating actuation of the press.

3. A cable harness assembly apparatus according to claim 2 wherein:

said cable cutting means is a blade mounted immediately adjacent a connector receiving recess in said fixture whereby the cable is trimmed immediately adjacent a connector.

4. A cable harness assembly apparatus according to claim 1 wherein said cable alignment means includes:

at least one pair of mating rollers on each side of said ram, said mating rollers having fluted surfaces defining therebetween a plurality of conductor channels whereby the cable is gripped by said pairs of rollers and accurately aligned with respect to said tool by the conductors of the cable being forced into their respective channels by said flutes.

5. A cable harness assembly apparatus for sequentially terminating a multi-conductor flat cable with a plurality of spaced apart connectors, each provided with a plurality of terminals having an insulation piercing configuration on at least one end thereof to engage the respective conductors of said cable, said apparatus comprising:

a base member;

a press mounted intermediate the ends of said base member including a vertically actuated ram carrying a conductor insertion tool on a free end thereof;

an index frame having a pair of parallel spaced side rail members, at least one of said rail members including means to effect an indexing movement of said frame beneath said ram, a plurality of connector carrying fixtures detachably fixed along said index frame spanning said side rail members in parallel spaced alignment, the end most of said fixtures including means to cut the cable substantially simultaneously with termination with a connector carried by said fixture;

means to move said frame so that the respective fixtures are sequentially positioned beneath the press in alignment with the tool;

means to feed multi-conductor flat cable beneath said ram in the direction of movement of said index frame with the conductors of the cable accurately aligned with said tool, said feed means including at least one pair of fluted rollers on each side of said press, said flutes defining a plurality of conductor passageways which force said conductors of said cable into predetermined positions;

whereby upon each actuation of the press the cable is sequentially terminated to a respective connector as they are indexed thereunder in a first direction and covers placed on the terminated connectors are applied to the connectors during indexing in the opposite direction.

* * * * *